US008904776B2

(12) United States Patent
Ha

(10) Patent No.: US 8,904,776 B2
(45) Date of Patent: Dec. 9, 2014

(54) CYLINDER DRIVING APPARATUS USING AIR PRESSURE

(76) Inventor: Seok-bong Ha, Busan (KR)

( * ) Notice: Subject to any disclaimer, the term of this patent is extended or adjusted under 35 U.S.C. 154(b) by 853 days.

(21) Appl. No.: 13/128,638

(22) PCT Filed: Oct. 14, 2009

(86) PCT No.: PCT/KR2009/005897

§ 371 (c)(1),
(2), (4) Date: May 10, 2011

(87) PCT Pub. No.: WO2010/053263

PCT Pub. Date: May 14, 2010

(65) Prior Publication Data

US 2011/0214562 A1 Sep. 8, 2011

(30) Foreign Application Priority Data

Nov. 10, 2008 (KR) ..... 10-2008-0111037

(51) Int. Cl.
*F01B 11/00* (2006.01)
*F01B 19/04* (2006.01)
*F01B 17/02* (2006.01)

(52) U.S. Cl.
CPC ..... *F01B 17/02* (2013.01); *F01B 19/04* (2013.01)
USPC ..... 60/370; 91/253

(58) Field of Classification Search
USPC ..... 60/370, 407; 91/5, 247, 253, 254, 255; 92/38
See application file for complete search history.

(56) References Cited

U.S. PATENT DOCUMENTS 3,974,744 A * 8/1976 Hedger ..... 92/34
4,170,166 A * 10/1979 Reed ..... 92/38
4,171,618 A * 10/1979 Aegerter ..... 60/370

FOREIGN PATENT DOCUMENTS

KR 10-0210368 4/1999
KR 10-1999-0062360 7/1999
KR 10-2005-0110566 11/2005

OTHER PUBLICATIONS

International Search Report for PCT/KR2009/005897 Mailed on Jun. 1, 2010.
Written Opinion of the International Searching Authority for PCT/KR2009/005897.
International Preliminary Report on Patentability.

* cited by examiner

*Primary Examiner* — Thomas E Lazo
(74) *Attorney, Agent, or Firm* — Revolution IP

(57) ABSTRACT

A cylinder driving apparatus using air pressure including: a plurality of flexible tubes arranged in a case to flexibly move via high-pressure air; a connecting rod fixed at each of the flexible tubes, and which penetrates through an upper portion of the case; a crank shaft sequentially coupled to the connecting rod to rotate via the elevating movement of the connecting rod; a high pressure tank for supplying high pressure air to the flexible tubes via an air line; and a valve arranged in each of the flexible tubes to divide the space in the flexible tube into an upper section and a lower section and to open or shut airflow in the upper and lower sections.

5 Claims, 7 Drawing Sheets

CYLINDER DRIVING APPARATUS USING AIR PRESSURE

RELATED APPLICATIONS

This application is a 371 application of International Application No. PCT/KR2009/005897, filed Oct. 14, 2009, which in turn claims priority from Korean Patent Application No. 10-2008-0111037, filed Nov. 10, 2008, each of which is incorporated herein by reference in its entirety.

TECHNICAL FIELD

The present invention relates to a cylinder driving apparatus using air pressure, and in particular to a cylinder driving apparatus using air pressure which a plurality of expansion tubes each connected to a crank shaft are filled with high pressure air and are alternately expanded by means of expansion energy and elevate, thus obtaining a rotational force by driving a crank shaft, and friction can be minimized, and gravitational force generated by self-weight can be offset, which force might interfere with an elevating movement, thus maximizing the efficiency that expansion energy of compressed air is converted into rotational movement.

BACKGROUND ART

[Relevant reference 1] Korean patent registration number 0041791, May 15, 1991

[Relevant reference 2] Korean patent registration number 0210368, Apr. 26, 1999

Conventional motors are driven by fossil energy such as gasoline, coal, gas, etc. the reciprocation movement of a piston of which generated by means of explosion is converted into a rotational movement via a crank.

However, the fossil energy source runs out because the amount of fossil energy is very limited in nature and serves to contaminate environment when in use.

DISCLOSURE OF INVENTION

Accordingly, it is an object of the present invention to provide a cylinder driving apparatus using high pressure air which makes it possible to significantly reduce the use of fossil energy to an extent of astonishing level while maximizing the efficiency of energy conversion. In particular, the present invention is directed to improving the structures of the relevant references 1 and 2 granted to the same applicant as the present invention, and the energy loss due to structural friction can be minimized, thus maximizing the efficiency of energy conversion into driving force energy to an extent of revolution, which leads to providing a new structure having an important value as alternative energy resource.

To achieve the above objects, there is provided a cylinder driving apparatus using air pressure which comprises a flexible tube repeatedly expanded and contracted by means of compressed air, and an assistant tube connected with the flexible tube and assisting elevation by supplementing pressure. The present invention is drawn from the Korean patent registration numbers 0041791 and 0210368 granted to the same applicant as the present invention by largely improving the above patents, thus providing a new energy resource by installing an assistant tube as a creative member.

Effects of the Invention

According to the present invention, a connecting rod fixed at each of a plurality of flexible tubes is connected to a crank shaft, thus obtaining a reliable rotational movement, and the flexible tubes filled with compressed air expand and elevate with the aid of air injection of high pressure air by the descending force of other flexible tubes and the compression force of the assistant tubes, so the expansion energy of air generating in the plurality of the flexible tubes serves to rotate the crank shaft with the aid of inter-operations, thus maximizing the efficiency of energy conversion.

The improvement of the energy efficiency helps reduce fossil energy, which results in the protection of the environment along with the application as clean energy with the aid of increased use of compressed air energy, thus obtaining a large effect in the energy field. The present invention might serve to provide a large value as an alternative energy and exchangeable energy resource.

In the conventional art, driving source is obtained using various fossil fuels, but the present invention makes it possible to provide environmentally friendly new energy resource to mankind along with obtaining stable life and economical developments while terminating energy problems due to high oil price, and the present invention might help change to all conventional energy sources or substitute the same.

BRIEF DESCRIPTION OF THE DRAWINGS

The present invention will become better understood with reference to the accompanying drawings which are given only by way of illustration and thus are not limitative of the present invention, wherein.

DESCRIPTIONS OF REFERENCE NUMERALS OF THE DRAWINGS

Figure 1:
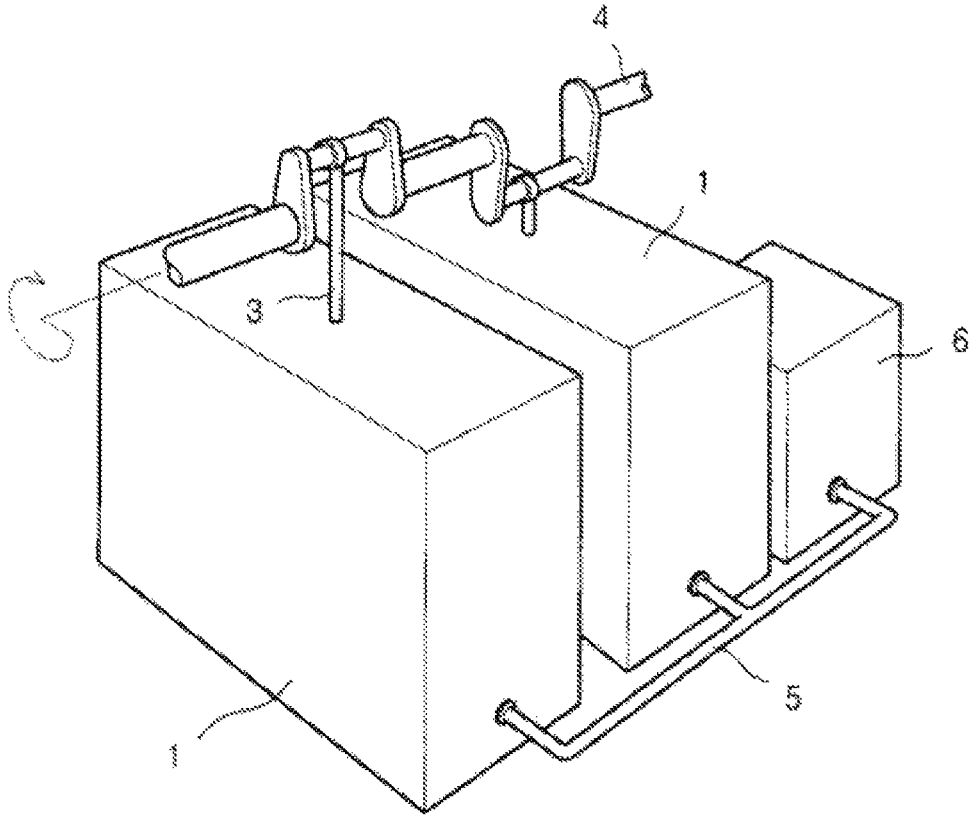
FIG. 1 is a perspective view of the whole outer look of the present invention.

1: casing
2: flexible tube
3: connecting rod
4: crankshaft
5: air line
6: high pressure tank
7: assistant tube
8: valve
9*a*, 9*b*: tensile spring
10*a*, 10*b*: through hole
11: partition
12: movement plate
13: valve slide
14*a*, 14*b*, 14*c*: link mechanism
15: assistant tub slide
16*a*, 16*b*, 16*c*: compression spring
17: elevating assistant apparatus
18: installation rod
19: pinion gear
20*a*, 20*b*: rack gear
21: releasing apparatus
22: engaging groove

23: fixing rod
24: engaging hook
25: fixing tube
26: releasing protrusion
27: height fixing apparatus
28: operation rod
29: protrusion
30: engaging rod
31*a*, 31*b*: guide tube
32: guide bar
33*a*, 33*b*: ventilation hole

MODES FOR CARRYING OUT THE INVENTION

The cylinder driving apparatus using air pressure according to the present invention is directed to improving the constructions consisting of a plurality of flexible tubes 2 installed in the interior of a casing 1 and being flexible with the aid of high pressure air, a connecting rod 3 which is fixed each flexible tube 2 and passes through the upper side of the casing 1, a crank shaft which is sequentially engaged to the connecting rod 3 and rotates with the aid of an elevation operation of the connecting rod 3, and a high pressure tank 6 supplying high pressure air to the flexible tube 2 via an air line 5.

Figure 2:
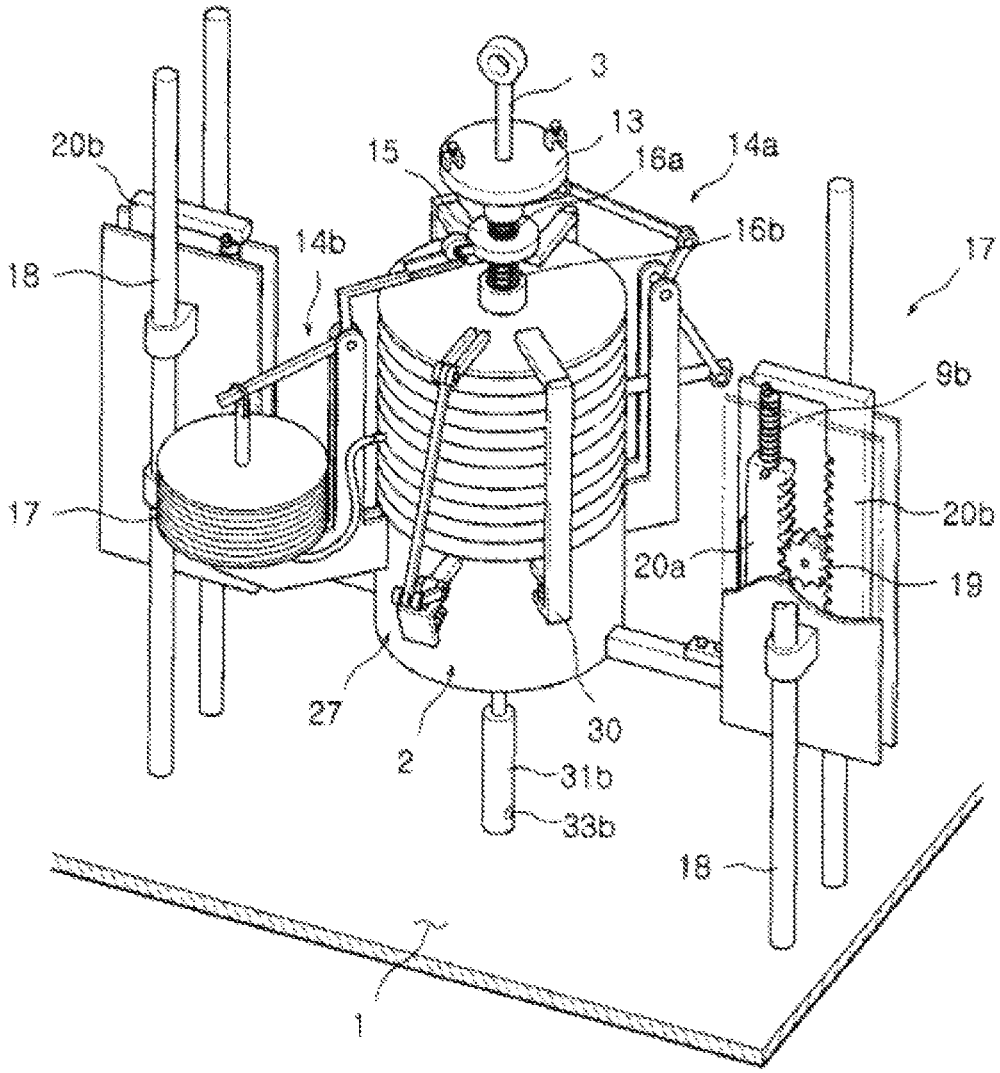
FIG. 2 is a perspective view of a structure installed in the interior of a casing.
Figure 3:
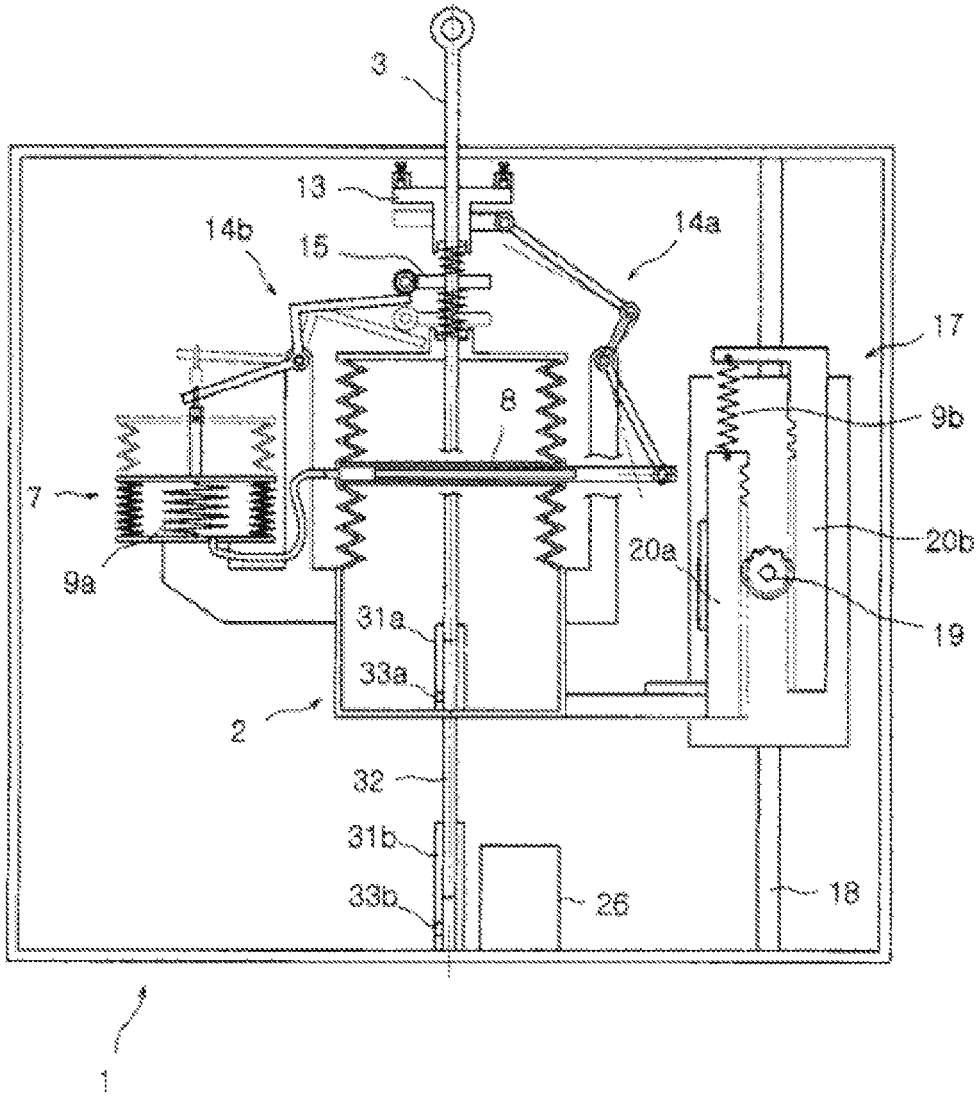
FIGS. 3 and 4 are vertical cross sectional views of a structure installed in the interior of one casing.
Figure 4:
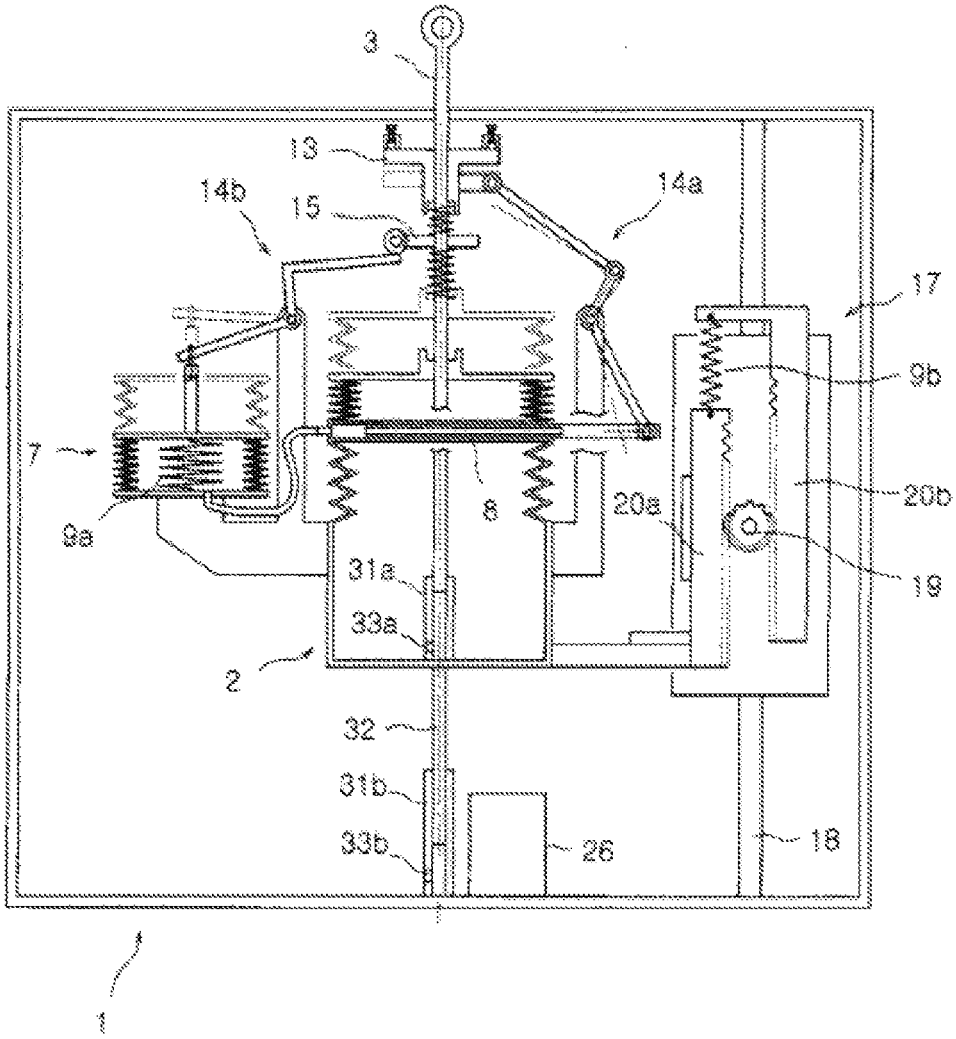

Namely, the present invention is directed to more efficiently utilizing the expansion energy of compression air by providing a flexible tube 2 and an assistant tube 7 of FIGS. 2 to 4.

As shown in FIG. 3, in case of the flexible tube 2, there are provided a valve 8 which is installed partitioning the interior of the flexible tube 2 into upper and lower spaces, thus opening and shutting the flow of air into the upper and lower spaces, the valve 8 remaining blocked so as to block the upper and lower spaces when the flexible tube 2 is filled with a high pressure air and being opened when the flexible tube 2 reaches the top dead point; and an assistant tube 7 which has a tensile spring 9*a* in its interior, thus having a spring force serving to maintain a compressed state and is connected to the valve 8, so the compressed air of the flexible tube 2 is moved to the assistant tube 7 when the valve 8 is opened.

Figure 5:
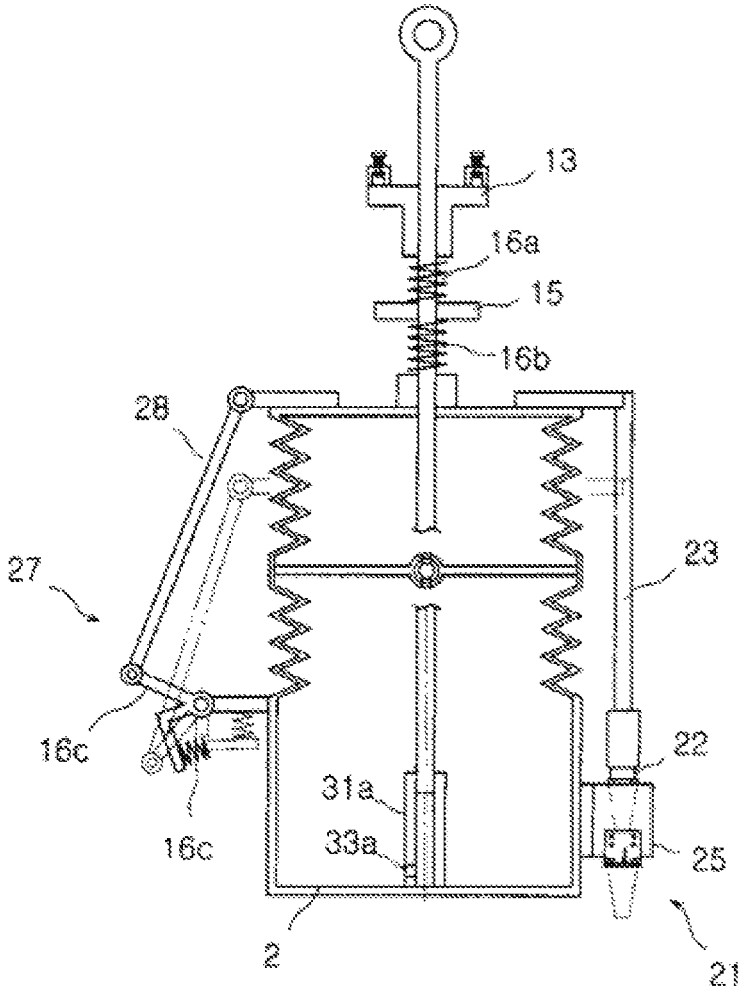
FIG. 5 is a view of the construction of a releasing apparatus and a height fixing apparatus of a flexible tube.
Figure 7:
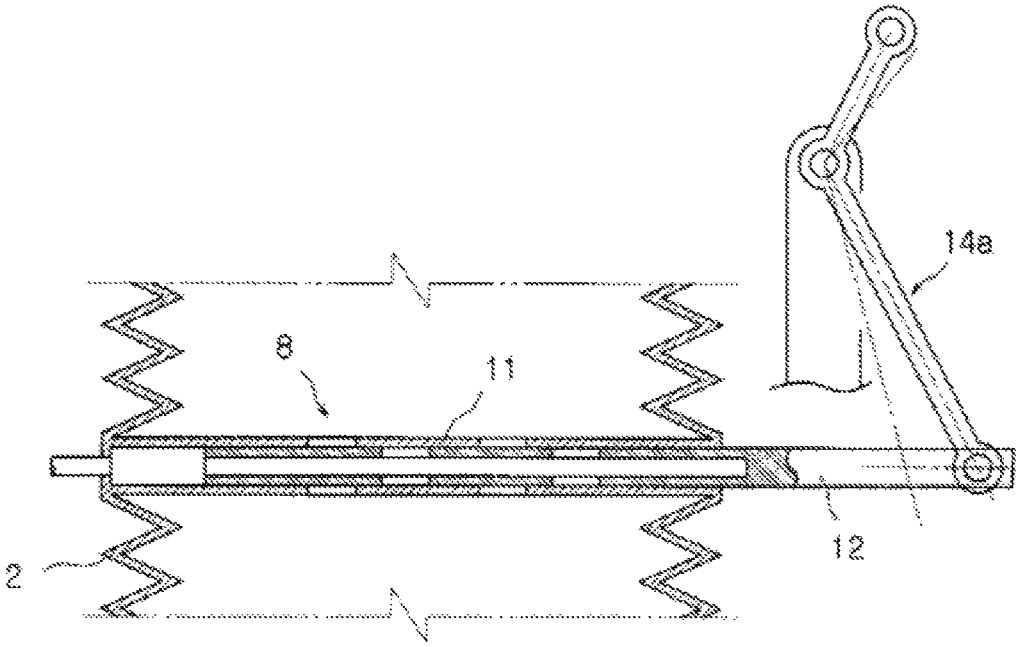
FIG. 7 is a detailed cross sectional view of a valve.

As shown in FIGS. 5 and 7, the valve 8 comprises a partition 11 partitioning the upper and lower spaces of the flexible tube 2 and having a plurality of through holes 10; and a movement plate 12 which is installed closer to the partition 11 and has a plurality of through holes 10*b* corresponding to the through holes 10*a*, respectively, the upper and lower spaces of the flexible tube 2 being opened and closed by means of a structure that the through holes 10*a* and 10*b* become communicates with each other by means of the movement of the movement plate 12.

As shown in FIG. 5, the valve 8 is configured in such a manner that the partition 11 serves to slit into upper and lower spaces, and the through holes 10*a* and 10*b* serve to form two tubes. Namely, the tube with a smaller diameter is inserted into the interior of the tube with larger tube, s the smaller tube serves as the movement plate 12.

As shown in FIG. 3, a valve slide 13 is inserted into the connecting rod 3 positioned in the interior of the casing 1 and ascends and descends along with the ascending and descending operations of the flexible tube 2, and a link mechanism 14*a* is engaged to the valve slide 13 and the movement plate 12 of the valve 8 by means of a pin, thus opening and shutting the valve 8 depending on the ascending and descending operation of the flexible tube 2.

As shown in FIG. 3, an assistant tube slide 15 is inserted into a lower side f the valve slide 13 inserted in the connecting rod 3 positioned in the interior of the casing 1 and ascends and descends along with the ascending and descending operations of the flexible tube 2, and a link mechanism 14*b* is engaged with the assistant tube slide 15 and the assistant tube 7 by means of a pin, thus flexing the assistant tube 7 depending on the ascending and descending operations of the flexible tube 2.

In the above construction, a compression spring 16*a* is disposed between the valve slide 13 and the assistant tube side 15, and a compression spring 16*b* is installed between the assistant tube slide 15 and the upper portion of the flexible tube 2. It is preferred that the compression spring 16*a* has smaller spring constant value than that of the compression spring 16*b*. So, the link mechanism 14*a* starts operating earlier than the link mechanism 14*b*.

As shown in FIGS. 2 to 4, there is provided an elevating assistant apparatus 17 for minimizing the influences of gravitational force due to self-weight when the flexible tube 2 moves upward. The elevating assistant apparatus 17 comprises an installation rod 18 vertically fixed at the casing 1, a pinion gear 19 rotatably fixed at the installation rod 18, a rack gear 20*a* engaged with the pinion gear 19 and fixed at the flexible tube 2, a rack gear 20*b* installed symmetrically with respect to the rack gear 20*a* and the pinion gear 19, and a tensile spring 9*b* connecting the upper portion of the rack gear 20*a* and the upper portion of the rack gear 20*b*.

The force decreasing due to the self-weight of the flexible tube 2 serves to move the rack gear 20*b* upwards with the aid of the rack gear 20*a* and the pinion gear 19, thus maintaining a stable position, namely, a balanced force in upward and downward directions.

Figure 6:
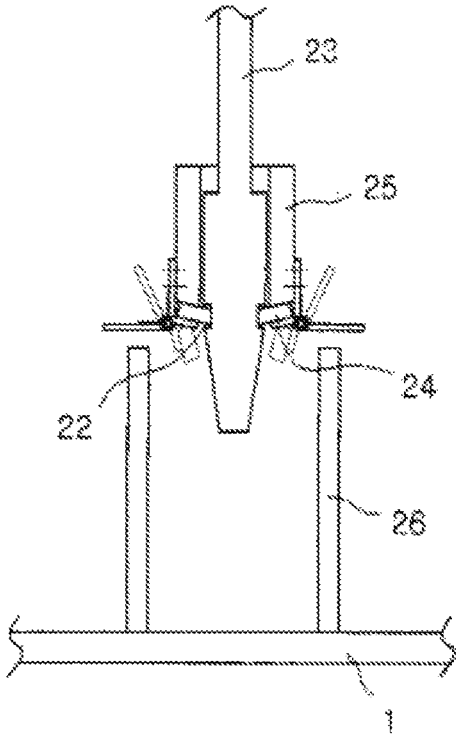
FIG. 6 is a detailed view of a releasing apparatus.

In addition, a releasing apparatus 21 is provided for the purposes that a certain constant height in upward and downward directions is maintained so that the flexible tube 2 is not fully expanded, and the flexible tube 2 can operate like instantly popping by instantly releasing the expansion energy of air, thus repeating the above operations. As shown in FIGS. 5 and 6, a releasing apparatus 21 is installed at the flexible tube 2. The releasing apparatus 21 comprises a fixing rod of which upper end is fixed at an upper side of the flexible tube 2 and which is longitudinally installed in a vertical direction and has an engaging groove formed at its lower side; a fixing tube 25 which is fixed at a lower side of the flexible tube 2 and is formed in a tube shape for receiving the fixing rod 23 and has an engaging hook 24 inserted into the engaging groove 22 and fixes the fixing rod 23 not to move, with its fixed state being released when moving only in the downward direction; and a releasing protrusion 26 which is protruded from a lower bottom side of the casing 1 and escapes the engaging hook 24 from the engaging groove 22 by contacting and pushing and rotating the engaging hook when the fixing rod 23 is engaged to the engaging hook 24 and moves toward the lower side together.

There is provided a height fixing apparatus 27 so that the height of the flexible tube 2 is fixed in a state that the flexible tube 2 is not fully compressed, but remains with a certain margin for compression, thus allowing the air to have expansion energy even in compressed state.

As shown in FIG. 5, the height fixing apparatus 27 comprises an operation rod 28 rotatably fixed at an upper portion of the flexible tube 2 with a pin, a protrusion 29 installed at a lower side of the flexible tube 2, and a link mechanism 14*c* which is shaft-supported at the operation rod 28 and the protrusion 20 with a pin and rotates by means of the operation rod 28 and fixes the flexible tube 2 not to rotate. A compression spring 16*c* is installed between the link mechanism 14*c* and the protrusion 29, thus loosening the impact when the link mechanism 14*c* is engaged to the protrusion 29.

There is provided a restriction apparatus for fixing the maximum height so as to prevent the maximum expansion of the flexible tube 2. As show in FIG. 8, the restriction apparatus is constructed in such a manner that the engaging rod 30 does not expand any longer, connecting the upper and lower sides of the flexible tube 2.

A connecting rod 3 is vertically installed in the interior of the flexible tube 2 and has a length to an extent that it does not reach the floor surface when the flexible tube 2 is compressed. A guide tube 31*a* is installed at the bottom of the flexible tube 2 for guiding elevation with the lower side of the connecting rod 3 being inserted. The through hole 33*a* is formed at the lower side of the guide tube 31*a*, thus preventing energy loss due to the resistance of inner air when the connecting rod 3 moves in the guide tube 31*a*.

A guide bar 32 is vertically installed at a lower side of the flexible tube 2, and a guide tube 31*b* is installed at the inner floor for guiding elevation as the guide bar 32 is inserted. The through hole 33*b* is formed at a lower axial surface of the guide tube 31*b*, thus eliminating the resistance due to air pressure when the guide bar 32 elevates.

As shown in FIG. 1, the structure of the present invention is directed to generating driving force as it is connected to the crank shaft 4 in multiple numbers. A structure such as a flexible tube 2 is installed at each casing 1, and high pressure air is sequentially fed from the high pressure tank 6, thus generating rotational force with the aid of the cylinder operation, which results in minimizing the loss of energy, obtaining a high efficiency rotational force.

FIG. 2 is a perspective view of a structure installed in the interior of each casing 1, and FIGS. 3 and 4 are vertical cross sectional views. As shown in FIG. 3, high pressure air is filled in the flexible tube 2 from the high pressure tank 6. When high pressure air is filled, external high pressure air is no longer filled in the same, which remains only during a certain operation stroke. When air pressure decreases later, high pressure air is filled again.

The flexible tube 2 filled with high pressure air moves upwards with the aid of the rotation of the crank shaft 4 on the basis of the downward movement of the connecting rod 3 of another flexible tube 2. The upward movement of the flexible tube 2 allows the fixed assistant tube 7 and the rack gear 20*a* to move upwards concurrently. The upward movement of the rack gear 20*a* serves to rotate the pinion gear 19 in clockwise direction, thus moving downward the rack gear 20*b*.

The elevating assistant apparatus 17 serves to prevent the downward moment due to the self-weight of the flexible tube 2, maintaining a balance, which is obtained by means of the operation of the rack and the pinion. So, the upward movement of the flexible tube 2 can be smoothly performed with the aid of the above operation.

While the flexible tube 2 is being elevated, the valve slide 13 inserted in the connecting rod 3 elevates and collides with the upper lower surface of the casing 1, and the flexible tube 2 can elevate a little more following the above operation with the aid of the compression springs. The assistant tube slide 15 sequentially moves upwards, and comes into contact with the compression spring 16*a* compressed at the lower side of the valve slide 13, and the compression sprig 16*b* comes into contact with the upper end portion of the flexible tub 2 and is compressed.

What the flexible tube 2 elevates is obtained sine the connecting rod 3 fixing the flexible tube 2 elevates by means of the crank shaft 4.

The valve slide 13 elevates along with the rise of the flexible tube 2, thus operating the link mechanism 14*a* connected thereto. As shown in FIG. 7, the movement tube 12 moves leftward with the aid of the link mechanism 14*a*. When the through hole 10*b* of the movement plate 12 is overlapped with the through hole 10*a* of the partition 11, the air of the flexible tube 2 moves toward the assistant tube 7.

The air having moved toward the assistant tube 7 serves to extend the assistant tube 7, and the assistant tube 7 is extended with the aid of the operation of the link mechanism 14*b* on the basis of the rise of the flexible tube 2, so the assistant tube 7 can be more easily extended with the aid of two operations.

The tensile spring 9*a* installed in the interior of the assistant tube 7 serves to perform its inherent functions in the next stage, which will be described later.

While the flexible tube 2 is elevating, its movement is guided in a state that the lower end portion of the connecting rod 3 is inserted in the guide tube 31*a* installed at the bottom of the flexible rube 2. A through hole 33*a* is formed for the elevation guide of the connecting rod 3 not to be interfered with by inner pressure or negative pressure. The inner pressure of the guide tube 31*a* always keeps same as the inner pressure of the flexible tube 2, so it is not interfered with by the elevation of the connecting rod 3.

The guide bar 32 installed at a lower side of the flexible tube 2 is inserted in the guide tube 31*b* installed at an inner lower surface of the casing 1 and elevates, but its movement is not interfered with by any other factors since the though hole 33*b* is formed at the guide tube 31*b*.

Figure 8:
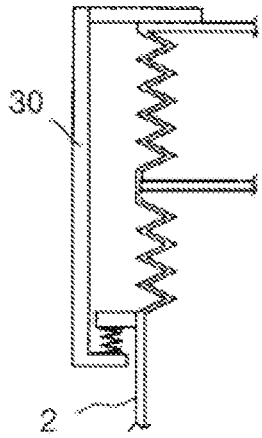
FIG. 8 is a view of a structure of a restriction apparatus.

As shown in FIG. 8, when the flexible tube 2 elevates, its height maintains at a certain height with the aid of the engaging rod 30, and as show in FIG. 6, it maintains a locked state by the releasing apparatus 21. High pressure air remains in the flexible tube 2 and keeps an expandable state.

When the flexible tube 2 reaches the top dead point and then moves downward, and the downward movement of the flexible tube 2 is performed along with the rack gear 20*a*, and the downward movement of the rack gear 20*a* serves to rotate the pinion gear 19 in the counterclockwise direction, by means of which the rack gear 20*b* moves upwards. At this time, the tensile spring 9*b* is extended and has an elastic force, the energy of which is used as an elevating energy of the flexible tube 2 in the next stage.

The downward movement of the flexible tube 2 serves to recover the valve slide 13 and the assistant tube slide 15 in a free state. With the aid of the compression spring 16*b* having a relatively larger spring constant value, the link mechanism 14*b* starts operating earlier than the link mechanism 14*a* being affected by the compression spring 16*a* having relatively smaller spring constant value. So, the assistant tube 7 operates first, and the assistant tube 7 is quickly compressed by the spring of the tensile spring 9*a* installed therein, along with the link mechanism 14*b*.

The compression air residing in the interior of the assistant tube 7 moves toward the flexible tube 2, and the valve 8 is shut by means of the operation of the link mechanism 14*a* on the basis of the operation of the compression spring 16*a*, and the inner state of the flexible tube 2 returns to its initial high pressure state.

As shown in FIG. 6, when the flexible tube 2 moves downwards, the engaging hook 24 rotates by means of the releasing protrusion 26 protruded from the bottom of the casing 1, so the fixing rod 23 becomes a free state. As shown in FIG. 5, the fixing rod 23 is a mean for compressing the flexible tube 2 and fixing the same, its release serves to free the expansion energy of the flexible tube 2, thus making the flexible tube 2 pop out like a ball. Even when the flexible tube 2 expands, it maintains a certain height with the aid of the engaging rod 30 of FIG. 8.

A plurality of the flexible tubes 2 sequentially operate by means of the expansion energy of compressed air, thus alternately and repeatedly performing ascending and descending operations, thus obtaining a driving force by rotating the crank shaft 4.

The invention claimed is:

1. A cylinder driving apparatus using air pressure including a plurality of flexible tubes 2 installed in the interior of a casing 1 and being flexible with the aid of high pressure air, a connecting rod 3 which is fixed to each flexible tube 2 and passes through the upper side of the casing 1, a crank shaft which is sequentially engaged to the connecting rod 3 and rotates with the aid of an elevation operation of the connecting rod 3, and a high pressure tank 6 supplying high pressure air to the flexible tube 2 via an air line 5, comprising:

a valve 8 which is installed partitioning the interior of the flexible tube 2 into upper and lower spaces, thus opening and shutting the flow of air into the upper and lower spaces, said valve 8 remaining blocked so as to block the upper and lower spaces when the flexible tube 2 is filled with high pressure air and being opened when the flexible tube 2 reaches the top dead point; and an assistant tube 7 which has a tensile spring 9*a* in its interior, thus having a spring force serving to maintain a compressed state and a connection to the valve 8, so the compressed air of the flexible tube 2 is moved to the assistant tube 7 when the valve 8 is opened.

2. A cylinder driving apparatus using air pressure according to claim 1, wherein said valve comprises:

a partition 11 partitioning the upper and lower spaces of the flexible tube 2 and having a plurality of through holes 10*a*; and a movement plate 12 which is installed closer to the partition 11 and has a plurality of through holes 10*b* corresponding to the through holes 10*a*, respectively, said upper and lower spaces of the flexible tube 2 being opened and closed by means of a structure such that the through holes 10*a* and 10*b* communicate with each other by means of the movement of the movement plate 12.

3. A cylinder driving apparatus using air pressure according to claim 1, wherein a valve slide 13 is inserted into the connecting rod 3 positioned in the interior of the casing 1 and ascends and descends along with the ascending and descending operations of the flexible tube 2, and a link mechanism 14*a* is engaged to the valve slide 13 and the movement plate 12 of the valve 8 by means of a pin, thus opening and shutting the valve 8 depending on the ascending and descending operation of the flexible tube 2.

4. A cylinder driving apparatus using air pressure according to claim 1, wherein an assistant tube slide 15 is inserted into a lower side of the valve slide 13 inserted in the connecting rod 3 positioned in the interior of the casing 1 and ascends and descends along with the ascending and descending operations of the flexible tube 2, and a link mechanism 14*b* is engaged with the assistant tube slide 15 and the assistant tube 7 by means of a pin, thus flexing the assistant tube 7 depending on the ascending and descending operations of the flexible tube 2.

5. A cylinder driving apparatus using air pressure according to claim 1, wherein a releasing apparatus 21 is installed at the flexible tube 2, said releasing apparatus 21 including:

a fixing rod of which upper end is fixed at an upper side of the flexible tube 2 and which is longitudinally installed in a vertical direction and has an engaging groove formed at its lower side;

a fixing tube 25 which is fixed at a lower side of the flexible tube 2 and is formed in a tube shape for receiving the fixing rod 23 and has an engaging hook 24 inserted into the engaging groove 22 and fixes the fixing rod 23 not to move, with its fixed state being released when moving only in the downward direction; and a releasing protrusion 26 which is protruded from a lower bottom side of the casing 1 and escapes the engaging hook 24 from the engaging groove 22 by contacting and pushing and rotating the engaging hook when the fixing rod 23 is engaged to the engaging hook 24 and moves toward the lower side together.

* * * * *